US012486690B2

(12) United States Patent
Lucas

(10) Patent No.: US 12,486,690 B2
(45) Date of Patent: Dec. 2, 2025

(54) FENCE GAP COVER

(71) Applicant: Beau Lucas, St. Petersburg, FL (US)

(72) Inventor: Beau Lucas, St. Petersburg, FL (US)

( * ) Notice: Subject to any disclaimer, the term of this patent is extended or adjusted under 35 U.S.C. 154(b) by 0 days.

(21) Appl. No.: 17/483,242

(22) Filed: Sep. 23, 2021

(65) Prior Publication Data

US 2023/0086176 A1 Mar. 23, 2023

(51) Int. Cl.
*E04H 17/16* (2006.01)
*E04H 17/00* (2006.01)

(52) U.S. Cl.
CPC ..... *E04H 17/1602* (2021.01); *E04H 17/013* (2021.01)

(58) Field of Classification Search
CPC . E04H 17/013; E04H 17/1602; Y10T 292/79; E06B 11/027; E06B 11/02; E05B 65/0007
See application file for complete search history.

(56) References Cited

U.S. PATENT DOCUMENTS 3,290,081 A * 12/1966 Sushan ..... E05B 17/2003 292/346
3,405,962 A * 10/1968 Sushan ..... E05B 17/2003 292/346
4,122,631 A * 10/1978 Batcheller ..... E05F 1/1215 49/386
4,130,311 A * 12/1978 Sushan ..... E06B 5/113 292/346
4,171,837 A * 10/1979 McRoy ..... E05B 15/0205 292/346
D258,716 S * 3/1981 Ciener ..... D8/343
D259,856 S * 7/1981 Ciener ..... D8/343
6,173,945 B1 * 1/2001 Lindsey ..... E04H 17/1413 256/65.14
6,263,630 B1 * 7/2001 Bennett ..... E04F 19/028 52/287.1
6,443,088 B1 * 9/2002 Putman ..... E05F 7/04 114/364
6,684,570 B1 * 2/2004 Robledo ..... E05B 65/0035 292/147
6,834,897 B1 * 12/2004 Walker ..... E05B 15/0205 292/340
7,147,213 B1 * 12/2006 Amendola ..... E06B 11/02 256/73
9,909,337 B1 * 3/2018 Moreno ..... E04H 17/22
10,676,958 B2 * 6/2020 Short ..... E04H 17/143
11,047,149 B1 * 6/2021 Fakhari ..... E04H 17/013
2008/0296547 A1 * 12/2008 Renteria ..... E04H 17/20 256/65.01
2016/0145893 A1 * 5/2016 Coulston ..... E04H 17/20 29/428

* cited by examiner

*Primary Examiner* — Matthew R McMahon

(57) ABSTRACT

The privacy device is a fence gap cover formed by two planar panels, the first planar panel having a longitudinal length equal to the height of the fence gate and a width wider than the gap between the gate and the fence post. The second planar panel extends perpendicular to and along the longitudinal length of the first planar panel. The second planar panel is attached to the fence post such that the first planar panel overlaps the front edges of the fence post and gate covering the gap. The fence gap cover may be cut to length to match the height of the gate and to allow for the latch and hinges.

5 Claims, 5 Drawing Sheets

FENCE GAP COVER

RELATED APPLICATION

The present patent application claims priority corresponding design patent application Ser. No. 29/793,010, entitled "Fence Gap Cover" filed on Feb. 16, 2021.

BACKGROUND OF THE INVENTION

Field of the Invention

The present invention relates to a Fence Gap Cover and more particularly pertains to a privacy device for use with a gated fence to cover the gap between the gate and the fence post.

Description of the Prior Art

The use of fence gap covers is known in the prior art. More specifically, fence gap covers previously devised and utilized for the purpose of covering the gap between a fence post and gate are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a Fence Gap Cover that provides a privacy device for use with a gated fence to cover the gap between the gate and the fence post.

In this respect, the Fence Gap Cover according to the present invention substantially departs from the conventional concepts and designs of the prior art, and in doing so provides an apparatus primarily developed for the purpose of providing a privacy device for use with a gated fence to cover the gap between the gate and the fence post.

Therefore, it can be appreciated that there exists a continuing need for a new and improved Fence Gap Cover which can be used for providing a privacy cover for use with a gated fence to cover the gap between the gate and the fence post. In this regard, the present invention substantially fulfills this need.

SUMMARY OF THE INVENTION

In view of the foregoing disadvantages inherent in the known types of coverings for fence gaps now present in the prior art, the present invention provides an improved Fence Gap Cover. As such, the general purpose of the present invention, which will be described subsequently in greater detail, is to provide a new and improved Fence Gap Cover and method which has all the advantages of the prior art and none of the disadvantages.

To attain this, for a broad perspective, the present invention essentially comprises a privacy device for use with a fence gate having fence posts on either side, the fence posts separated from the sides of the gate by a gap. The gate having a latch on one side removable coupling the gate to the fencepost and one or more hinges on the opposite side coupling the gate to the opposite fencepost.

The privacy device is a fence gap cover formed with two planar panels, the first planar panel having a longitudinal length equal to the height of the fence gate and a width wider than the gap between the gate and the fence post. The second planar panel extends perpendicular to and along the longitudinal length of the first planar panel. The second planar panel is attached to the fence post such that the first planar panel extends across the distance between the front edges of the fence post and the gate covering the gap. The fence gap cover may be cut to length to match the height of the gate and to allow for the latch and hinges.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Fence Gap Cover which has all of the advantages of the prior art covering for fence gaps and none of the disadvantages.

It is another object of the present invention to provide a new and improved Fence Gap Cover which may be easily and efficiently manufactured and marketed.

It is a further object of the present invention to provide a new and improved Fence Gap Cover which is of durable and reliable constructions.

An even further object of the present invention is to provide a new and improved Fence Gap Cover which is susceptible of a low cost of manufacture with regard to both materials and labor, and which accordingly is then susceptible of low prices of sale to the consuming public, thereby making such Fence Gap Cover economically available to the buying public.

Lastly, it is an object of the present invention to provide a Fence Gap Cover for providing a privacy cover for use with a gated fence to cover the gap between the gate and the fence post that is easily installed and can be cut to fit the desired fence gap.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
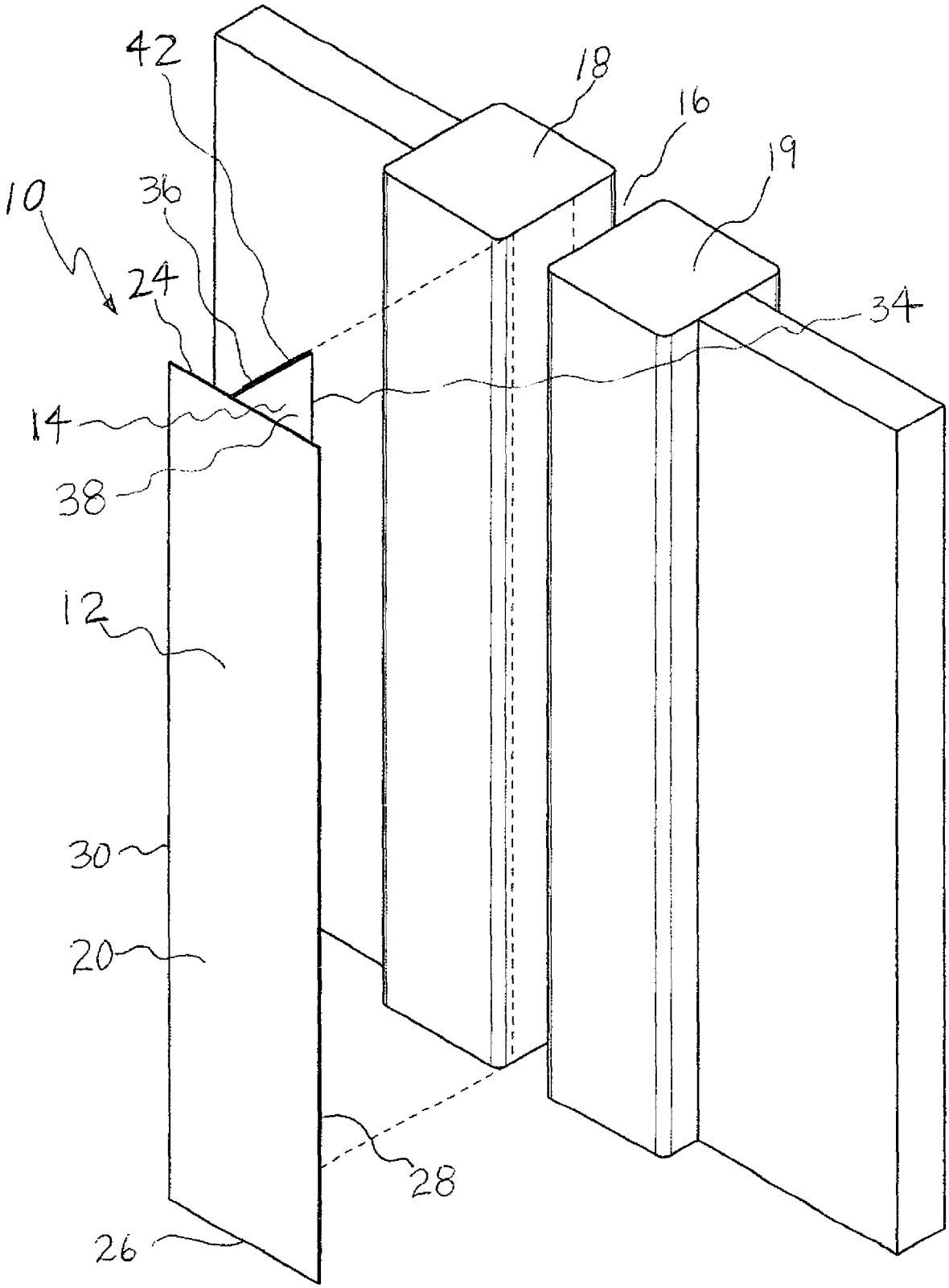
FIG. 1 is a perspective view of a fence gap cover for covering the gap between a fence and a gate constructed in accordance with the principles of the present invention prior to installation on the fence.
Figure 2:
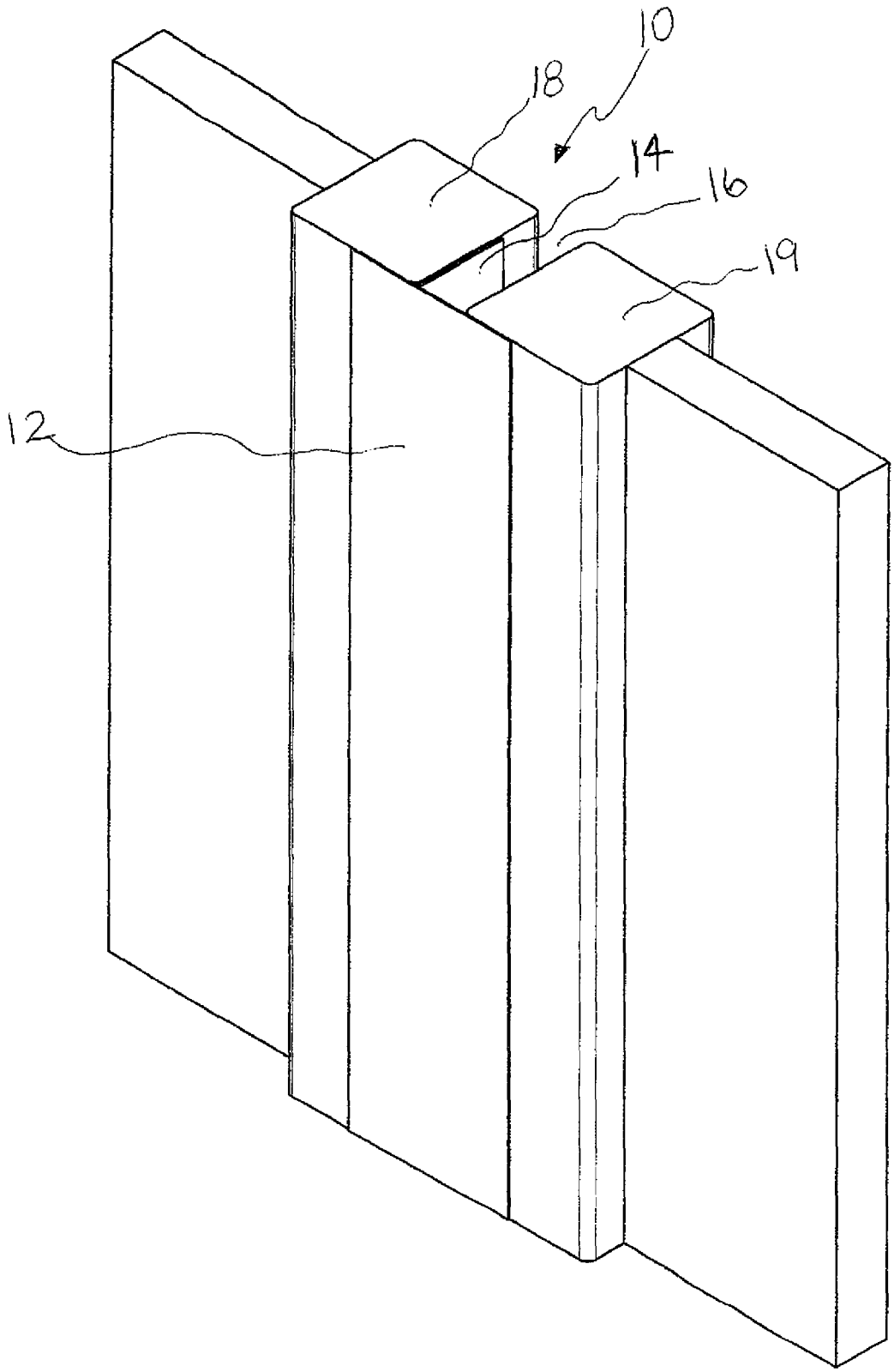
FIG. 2 is a perspective view of a fence gap cover for covering the gap between a fence and a gate installed on a fence and constructed in accordance with the principles of the present invention.
Figure 3:
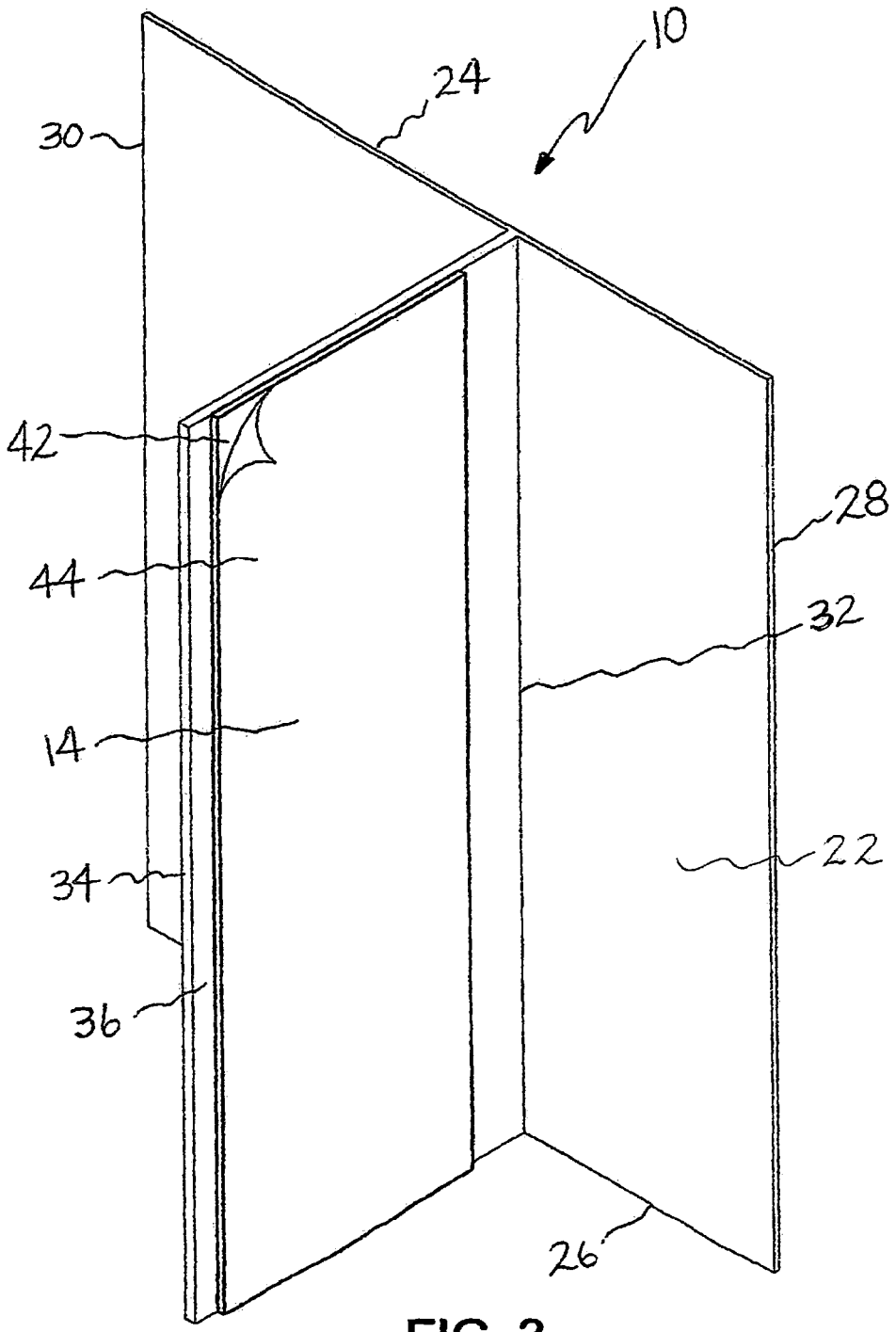
FIG. 3 is a rear perspective view of a fence gap cover.
Figure 4:
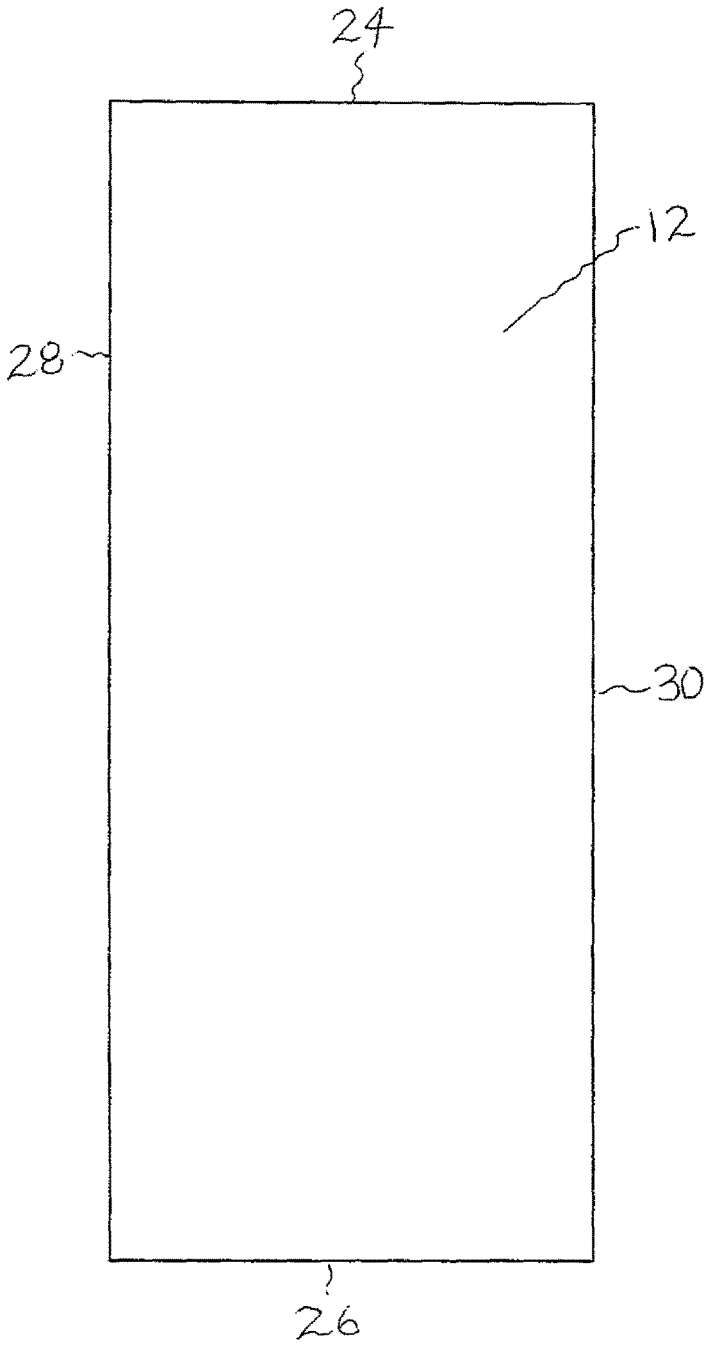
FIG. 4 is a front view of a fence gap cover.
Figure 5:
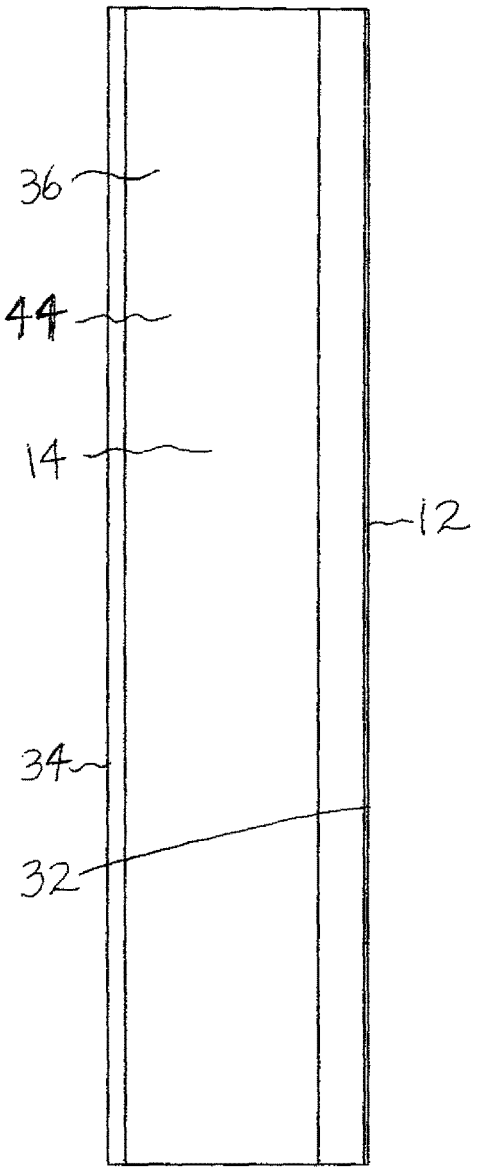
FIG. 5 is a side view of a fence gap cover showing the fence side.
Figure 6:
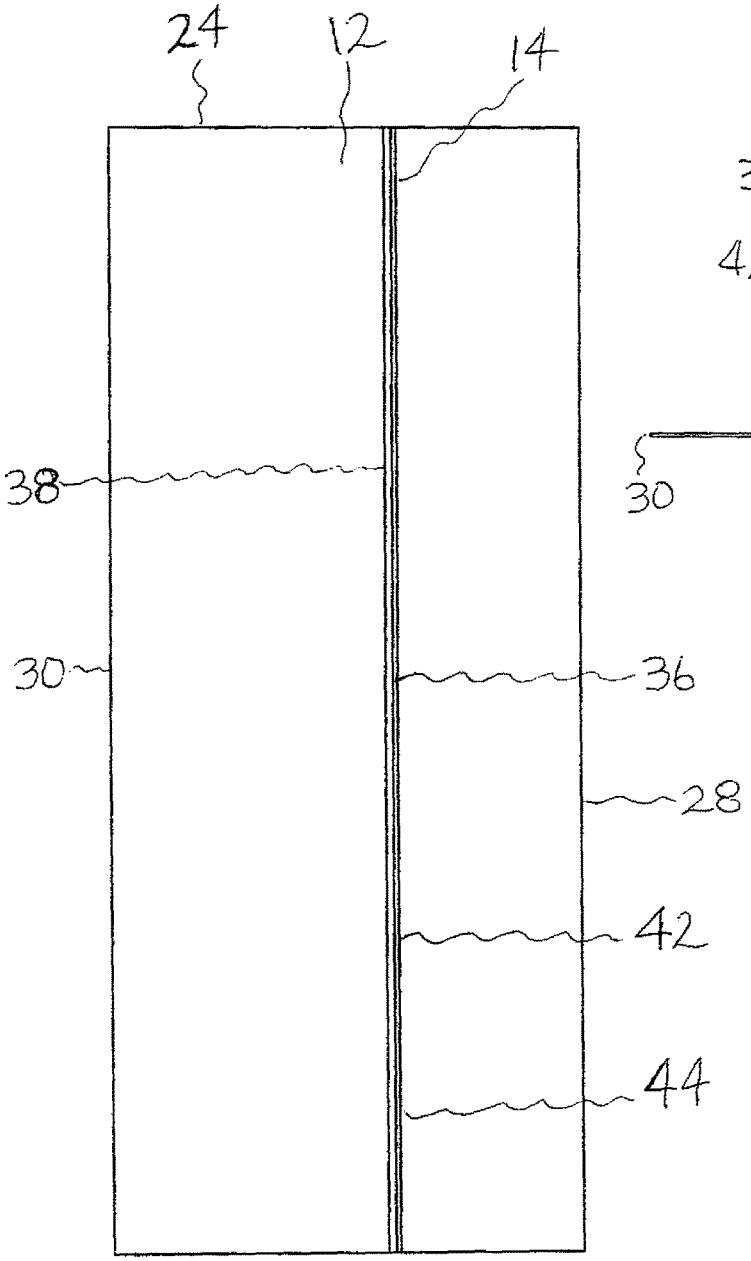
FIG. 6 is a rear view of a fence gap cover.
Figure 7:
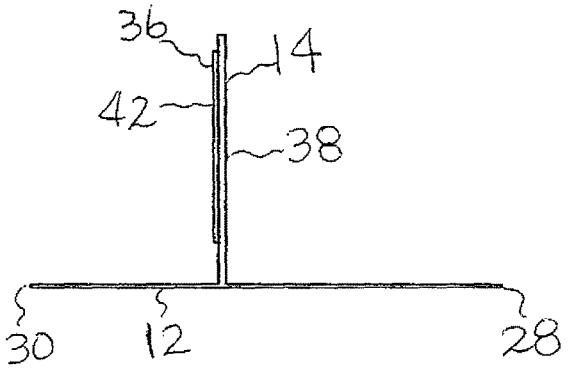
FIG. 7 is a top view of a fence gap cover.

With reference now to the drawings, and in particular to FIG. 1 thereof, the preferred embodiment of the new and improved Fence Gap Cover embodying the principles and concepts of the present invention and generally designated by the reference numeral 10 will be described.

The present invention, the Fence Gap Cover 10 is comprised of a plurality of components. Such components in their broadest context include a first planar panel 12 formed as a privacy panel for covering a gap 16, a second planar panel 14 perpendicular to the privacy panel for securely attaching to a fencepost 18, a means for securely attaching the secondary panel to a fence post. The fence gap cover sizable to different lengths by cutting to fit the height of a fence gate 19 for the purpose of covering the gap between the fence post and the gate. Such components are individually configured and correlated with respect to each other so as to attain the desired objective.

From a specific perspective, the invention of the present application is a fence gap cover 10 formed with a first planar panel 12 and a second planar panel 14. The first planar panel having a front face 20 and a rear face 22 with a thickness there between. The first planar panel has a top edge 24 and a bottom edge 26 with a length there between. The first planar panel having a gate side edge 28 and a post side edge 30.

The second planar panel 14 extends perpendicular to the rear face 22 along the longitudinal length of the first planar panel. The second planar panel has a front edge 32 and a rear edge 34 with a width there between. The second planar panel is formed with an inside face 36 and an outside face 38 with a thickness there between.

A means is provided for securely attaching the second planar panel to a fence post. In the preferred embodiment the means for securely attaching the fence gap cover to the fence post includes an adhesive strip 42 running the longitudinal length of the inside face of the second planar panel. The adhesive is covered by a removable protective barrier 44. The removable protective barrier is separated from the adhesive, exposing the adhesive prior to adhering the inside face of the second planar panel to a fence post.

The first planar panel and second planar panels are integrally molded of a rigid material chosen from the class of rigid materials including polyvinyl chloride (PVC), vinyl, polymer, plastic and composite.

In one embodiment the second planar panel bisects the first planar panel a distance of 35-45 percent of the distance between the post side edge and the gate side edge of the first planar panel.

In an alternate embodiment the second planar panel extends perpendicular to the first planar panel along the post side edge.

In the preferred embodiment the distance between the right side and the left side of the first planar panel is 2.5 inches plus or minus 20%. The width of the second planar panel is 1.3 inches plus or minus 20%. In the preferred embodiment the second planar panel bisects the first planar panel 1 inch plus or minus 10% from the right side of the first planar panel. In the preferred embodiment the thickness of the first planar panel is 0.5 mm plus or minus 10% and the thickness of the second planar panel is 1 mm plus or minus 10 percent.

In an alternate embodiment the fence gap cover can be attached using a mechanical connector taken from a class of mechanical connectors including screws and nails to securely attach the second planar panel to a fence post.

The fence gap cover may be inverted to attach to the opposite fence post.

The fence gap cover is designed for use with a fence gate having fence posts on either side, the posts separated from the sides of the gate by a gap. The gate having a latch on one side removably coupling the gate to the fencepost and one or more hinges on the opposite side, the hinges coupling the gate to the opposite fencepost.

The fence gap cover is installed on the latch side of the gate by first measuring the height of the gate then measuring and cutting the fence gap cover to match the height of the gate. If needed the fence gap cover can be cut to accommodate the latch by cutting a first length between the top of the gate and the latch, measuring the second length between the latch and the bottom of the post, cutting the fence gap cover to match the first length forming a top fence gap cover and cutting the fence gap cover to match the second length forming a bottom fence gap cover. The inside face of the top fence gap cover pieces are coupled to the fence post adjacent to the gap against the corresponding parts of the fence post. In the preferred embodiment the fence gap cover is coupled to the fence past by first removing the removable protective barrier exposing the adhesive and then pressing the adhesive against the post, securely attaching the second planar panel to the fence post adjacent to the gap. The first planar panel extends across the gap between the fence post and the gate, blocking the view through the gap. The fence gap cover may be installed on the hinge side of the gate by measuring the first length between the top of the gate and the hinge. Measuring the second length between the top hinge and the bottom hinge. Measuring the third length between the bottom hinge and the bottom of the gate, cutting the fence gap cover to match the first length forming a top fence gap cover, cutting the fence gap cover to match the second length forming a middle fence gap cover, cutting the fence gap cover to match the third length forming a bottom fence gap cover. Placing the inside face of the top fence gap cover pieces against the corresponding parts of the fence post in line with the gate and securing the inside face of the second planar panel to the fence post. In the preferred embodiment removing the removable protective barrier exposing the adhesive, pressing the adhesive against the post, securely attaching the second planar panel to the fence post. The first planar face extends across the gap, blocking the view through the gap.

The Fence Gap Cover is a device to insure privacy and may be used to cover an open gap between a gate and the supporting fence posts. The width of the device is sufficient to cover the gap extending to cover a portion of the fence post and gate to create an aesthetically pleasing cover and to provide privacy by blocking visibility through the fence gap. The lengths can be varied and cut by the user to the user's preferred length in order to accommodate the latch and hinges and gates of different heights. The inside portion has an adhesive that adheres to the inside of the fence post, while the outside flap or portion covers the gap or space.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fence gap cover for covering a gap between a fence post and a gate, the fence gap cover comprising:

a first planar panel and a second planar panel, the first planar panel having a front face and a rear face with a thickness there between, the thickness being constant along the entire first planar panel, the first planar panel having a top edge and a bottom edge with a longitudinal length there between, the first planar panel having a post side edge and a gate side edge;

the second planar panel extending perpendicular to the rear face along the longitudinal length of the first planar panel forming an offset T, the second planar panel having a longitudinal length equal to the longitudinal length of the first planar panel, the second planar panel having a front edge and a rear edge with a width there between, the second planar panel having an inside face and an outside face with a thickness there between, the thickness being constant along the entire second planar panel, the thickness of the second planar panel being two times the thickness of the first planar panel; and a coupling component to securely attach the second planar panel to a fence post.

2. The fence gap cover as set forth in claim 1 wherein the coupling component includes an adhesive layer on the inside face of the second planar panel extending the length of the second planar panel between the front edge and the rear edge of the second planar panel, the adhesive covered by a removable protective barrier.

3. The fence gap cover as set forth in claim 1 wherein the first planar panel and second planar panel are integrally molded of a rigid material chosen from the class of rigid materials including polyvinyl chloride (PVC), vinyl, polymer, plastic and composite.

4. The fence gap cover as set forth in claim 1 wherein the second planar panel bisects the first planar panel a distance of 35-45 percent of the distance between the post side edge and the gate side edge of the first planar panel.

5. A fence gap cover for covering a gap between a fence post and a gate, the fence gap cover comprising:

a first planar panel and a second planar panel, the first planar panel having a front face and a rear face with a thickness of 0.5 mm plus or minus 10% there between, the thickness being constant along the entire first planar panel, the first planar panel having a top edge and a bottom edge with a longitudinal length there between, the first planar panel having a post side edge and a gate side edge with a distance there between forming a first width, the second planar panel extending perpendicular to the rear face along the longitudinal length of the first planar panel, the second planar panel having a front edge and a rear edge with a distance there between forming a second width, the first width greater than the second width, the second planar panel having an inside face and an outside face with a thickness of 1 mm plus or minus 10% there between, the thickness being constant along the entire second planar panel;

the second planar panel bisecting the first planar panel a distance of 35-45 percent of the distance between the post side edge and the gate side edge of the first planar panel;

the first planar panel and the second planar panel are integrally molded of a rigid material chosen from the class of rigid materials including polyvinyl chloride (PVC), vinyl, polymer, plastic and composite;

an adhesive layer on the inside face of the second planar panel extending the longitudinal length of the second planar panel between the front edge and the rear edge of the second planar panel, the adhesive covered by a removable protective barrier; and a gate, a fence post adjacent to the gate, a gap between the fence post and the gate for receiving the second planar panel of the fence gap cover, the adhesive coupling the inside face of the second planar panel to the fence post.

* * * * *